US008002211B2

(12) United States Patent
Lewis, Jr. et al.

(10) Patent No.: US 8,002,211 B2
(45) Date of Patent: Aug. 23, 2011

(54) SCRAP MATERIAL SHREDDING AND COMPRESSING APPARATUS AND SYSTEM

(76) Inventors: James L. Lewis, Jr., Calabash, NC (US); James L. Lewis, Sr., Calabash, NC (US)

( * ) Notice: Subject to any disclaimer, the term of this patent is extended or adjusted under 35 U.S.C. 154(b) by 221 days.

(21) Appl. No.: 12/284,052

(22) Filed: Sep. 18, 2008

(65) Prior Publication Data

US 2009/0078805 A1 Mar. 26, 2009

Related U.S. Application Data

(60) Provisional application No. 60/994,591, filed on Sep. 20, 2007.

(51) Int. Cl.
*B02C 13/286* (2006.01)

(52) U.S. Cl. ..... 241/79.1; 241/186.35; 241/186.4; 241/101.4

(58) Field of Classification Search ..... 241/186.35, 241/186.4, 79, 79.1, 101.4
See application file for complete search history.

(56) References Cited

U.S. PATENT DOCUMENTS 3,103,163 A 9/1963 Gates
3,934,499 A 1/1976 Strom
4,374,573 A 2/1983 Rouse et al.
4,504,019 A * 3/1985 Newell et al. ..... 241/73
4,993,649 A 2/1991 Koenig
5,213,686 A 5/1993 Funk et al.
5,645,234 A * 7/1997 Del Zotto ..... 241/101.76
5,996,913 A * 12/1999 van der Beek et al. ..... 241/34

OTHER PUBLICATIONS www.sierraintl.com.
www.rossmach.com.
"Recycling Today", trade publication.
www.metso.com.

* cited by examiner

*Primary Examiner* — Mark Rosenbaum
(74) *Attorney, Agent, or Firm* — P. Jeff Martin; The Law Firm of P. Jeffrey Martin, LLC

(57) ABSTRACT

A scrap material recycling apparatus includes a feeder, a shredder and a separator, the feeder and the shredder mutually coupled, and the shredder and separator mutually coupled. The feeder includes a means for compressing a quantity of scrap material and means for advancing the scrap material to the shredder. The shredder includes a rotor having a plurality of cutting means, the rotor mechanically rotated to reduce the scrap material. The separator separates the reduced scrap material by fractional composition. The recycling apparatus may be part of a system further incorporating additional components, such as conveyors and/or dust extraction devices. The recycling apparatus may be further adapted so as to be a transportable system, thereby allowing such system to be relocated at or near scrap material stockpile locations.

5 Claims, 3 Drawing Sheets

SCRAP MATERIAL SHREDDING AND COMPRESSING APPARATUS AND SYSTEM

RELATED APPLICATIONS

This application claims the benefit of U.S. Provisional Application No. 60/994,591 filed on Sept. 20, 2007.

BACKGROUND OF THE INVENTION

1. Field of the Invention

The present invention relates generally to compressing and fragmentizing apparatuses utilized in converting scrap material into reusable material. In particular, the present invention relates to an improved fragmentizing and compressing apparatus and system that compresses, shreds, separates, and discharges the converted scrap material, and which may provide that the apparatus(es) and/or system is mobile or transportable from one location to another.

2. Description of the Related Art

Presently, the convergence of cost savings and environmental sensitivity has generated a demand for apparatuses and systems that can more economically recycle material previously recycled in other ways or were discarded to a landfill. In particular, scrap material resulting from the use of metal, plastic, rubber, glass, ceramic, wood or other similarly used material, has emerged as a valuable commodity as a means for extracting optimal consumption from a particular quantity of material. In optimizing consumption throughout the production and use cycle, manufacturers and consumers alike may realize long-term costs savings in reducing the need for purchasing new or virgin replacement materials, reducing raw material costs and in minimizing waste disposal costs. Additionally, the disposal of such materials may require special efforts or permits compliant with environmental laws and/or regulations. A further optimization of the consumption cycle is realized in the reduction of transportation costs afforded by the invention and its capability to be located at or near the scrap stock site, eliminating a haulage step from the recycling process.

The aforementioned concerns are particularly acute with metal materials, including but not limited to steel, iron, copper, brass, nickel, and aluminum, which are becoming increasingly expensive to purchase and utilize in a manufacturing process. The utilization of the disclosed apparatus(es) and/or system provides a means for reducing excess scrap stock (at the manufacturer, consumer, and waste-disposal level) by compressing and shredding the material into scrap feedstock that is further separable by size and/or composition, if desired. Of particular interest, the invention may be arranged and housed in such a manner as to be mobile or transportable to a site possessing excessive amounts of scrap material that might otherwise be more costly and/or difficult to recycle than what can be achieved by the apparatus(es) and system disclosed herein.

Thus far, the applicant is unaware of any apparatus, device, system or method which disclose the elements of the apparatus(es) and/or system disclosed herein. To date, the prior art discloses a variety of apparatuses and systems that attempt to recycle scrap material in an efficient and convenient manner, including compression apparatus and shredding systems.

However, the present invention provides an improvement over the arrangement, operation and results of the prior art in this field of endeavor. To those skilled in the art, it is well known that a compression apparatus is often coupled to a cutting apparatus (commonly referred as a shear) to reduce the compressed materials into a usable size fraction for metals melting. A limitation of this art is that commingled materials, such as occur in obsolete (end-of-life) durable goods, for example, automobiles, appliances, and the like, remain commingled in a state requiring further, often costly, reduction to separate the materials into acceptably pure fractions. Also well known to those skilled in the art, shredders or pulverizers are used to reduce commingled materials to a size fraction that permits the separation of the commingled materials into acceptably pure fractions. A limitation of this art is that large scale obsolete materials require a shredder size sufficient to receive the materials, such as, for example, an obsolete automobile. The shredder size required in such cases is limited to large scale, high throughput, permanently installed machinery, typically located in metropolitan areas where collected material must be hauled some distance to the operation. Such haulage of collected material becomes less profitable as fuel costs escalate. The economic scale presented by this size requirement creates further limitations to cost reductions through the larger operation and maintenance cost of the business.

The invention disclosed herein overcomes the aforementioned limitations by providing the means to shred or fragmentize said materials, such as obsolete automobiles, by first compressing the materials into a compact form that is then fed directly to a small size shredder which reduces the compressed material to the desired size for later separation into desirable fractions. This apparatus, because of its considerably smaller size, may be mounted on a mobile structure, such as a trailer, or on a road-transportable skid such that the recycling process can be located wherever said recyclable materials may be stocked. In this manner, a haulage step is eliminated from the recycling process and the scale of operational cost is reduced.

A search of the prior art did not disclose any patents that read directly on the claims of the instant invention; however, the following references were considered related.

U.S. Pat. No. 4,993,649, issued in the name of Koenig discloses a dual auger shredder adapted for the processing of large scale bulk.

U.S. Pat. No. 5,213,686, issued in the name of Funk et al. discloses an apparatus and method for the effective compaction of compressible material during industrial processes.

U.S. Pat. No. 4,374,573, issued in the name of Rouse et al. discloses a portable apparatus for shredding fiber-reinforced resilient material such as tires and other waste materials.

U.S. Pat. No. 3,934,499, issued in the name of Strom discloses a shredding system for shredding large pieces of metal scrap.

U.S. Pat. No. 3,103,163, issued in the name of Gates discloses a transportable scrap metal salvage machine for reducing relatively thin-walled metal bodies to a compact mass suitable for feeding into a melting furnace.

Also considered related are Internet publications provided at www.metso.com, www.sierraintl.com and at www.rossmach.com. Also considered related is the trade publication Recycling Today.

SUMMARY OF THE INVENTION

In one aspect of the disclosed embodiments, a scrap material recycling apparatus comprises a feeder, a shredder and a separator, the feeder and the shredder mutually coupled, and the shredder and separator mutually coupled. The feeder comprises a means for compressing a quantity of scrap material and means for advancing the scrap material to the shredder. The shredder comprises a rotor having a plurality of cutting means, such as teeth, knives, or hammers, wherein the rotor mechanically rotates to reduce the scrap material. The separator sorts the reduced scrap material by fractional composition.

In accordance with the aforementioned embodiment, and other envisioned combinations of embodiments, the compression means may comprise a pair of arms that are inwardly biased. The arms may comprise means for actuating movement of the arms between opened and closed positions, wherein actuating means may comprise mechanical cylinders, including hydraulic, pneumatic or other types of cylinders, or other means for actuating arm motion. The arms or other compression means impart high compressive force compressing the scrap material for transfer to the shredder.

In accordance with the aforementioned embodiment, and other envisioned combinations of embodiments, advancing means may comprise a telescoping ram cylinder, a toothed feed roll, or a conveyor, among several possibilities, for advancing the scrap material from the feeder to the shredder.

In accordance with the aforementioned embodiment, and other envisioned combinations of embodiments, the shredder may comprise an inlet and an outlet mutually opposed, the inlet receiving scrap material from the feeder, and the outlet delivering scrap material to the separator. The separator may comprise an electromagnetic means, such as at least one magnet or an eddy current device, a pneumatic means, such as an air classifier, a fluid bed, or a destoner, or a mechanical means, such as a splitter chute, a roller screen, or a vibratory screen for separating shredded materials into fractional compositions, such as ferrous, non-ferrous, and non-metallic materials.

In another aspect of the disclosed embodiments, a system for processing scrap material is disclosed, the system comprises a compressing apparatus compressing scrap material, a shredding apparatus having means for shredding the scrap material, means for advancing the scrap material from the compressing apparatus to the shredding apparatus, a discharge apparatus; means for separating shredded materials into fractional compositions in preparation for discharge of the scrap materials, and means for advancing the scrap material from the shredding apparatus to the discharge apparatus.

In accordance with this and other envisioned embodiments and combinations of embodiments, advancing means may comprise a telescoping ram cylinder, a toothed feed roll or a conveyor.

In accordance with this and other envisioned embodiments and combinations of embodiments, the separator may comprise at least one magnet, an eddy current device, an air separator, a mechanical separator, or a combination of one or more of these elements, for separating shredded materials into fractional compositions.

In another aspect of the disclosed embodiments, a system for processing scrap material is disclosed, the system comprises a power plant for providing power to the system and the constituent elements, a feeder apparatus compressing the scrap material for shredding, at least one metal shredder, means for conveying the scrap material from the feeder apparatus to the metal shredder, at least one discharge conveyor for advancing the scrap material from the shredder to a separation area, and means for separating shredded materials into fractional compositions.

The system may further comprise at least one residue conveyor for non-metallic residue, or at least one stacking conveyor, or at least one dust extraction means, separately or in combination within the disclosed system(s). The system may further comprise a plurality of controls for operating the system, including separate operational controls for each element and each constituent sub-element of the disclosed elements.

The system may further comprise separating means comprising one or more electromagnetic devices, or a pneumatic separator, or a mechanical separator, or a combination of these elements.

It is envisioned that each of the embodiments disclosed, including the apparatus and/or system(s) may be placed on or formed as an integral unit of a transportable apparatus, such as a flat bed trailer or other similar device suitable for housing and transporting such an apparatus or system.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

Detailed Description of the Figures

Referring now to FIG. 1 through FIG. 6B, an apparatus for shredding and/or compressing scrap material into a recyclable and reusable feedstock source that may be utilized as a separate device or in combination with a larger system for reducing scrap material M is disclosed. As disclosed, the apparatus 10 generally comprises a feeder 12, a shredder 14 and a separator 16. The feeder 12 and the shredder 14 are mutually coupled to one another, and the shredder 14 and the separator 16 are mutually coupled to one another. The feeder 12 provides a collection point for the various materials M to be recycled, and further provides compression of the material into a size suitable to be fed into the shredder 14. The compressed scrap material M advances from the feeder 12 to the shredder 14, which shreds and/or grinds the material M into smaller portions. The reduced material M then advances from the shredder 14 to the separator 16, which separates the material M into its fractional composition(s) for collection or categorizing.

Figure 2:
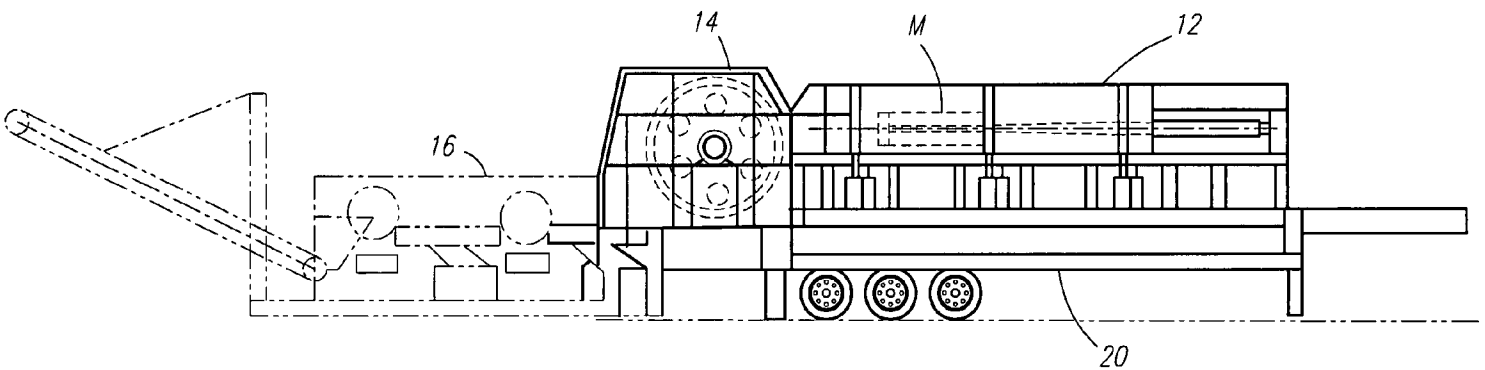
FIG. 2 is an elevation view of the FIG. 1.
Figure 4:
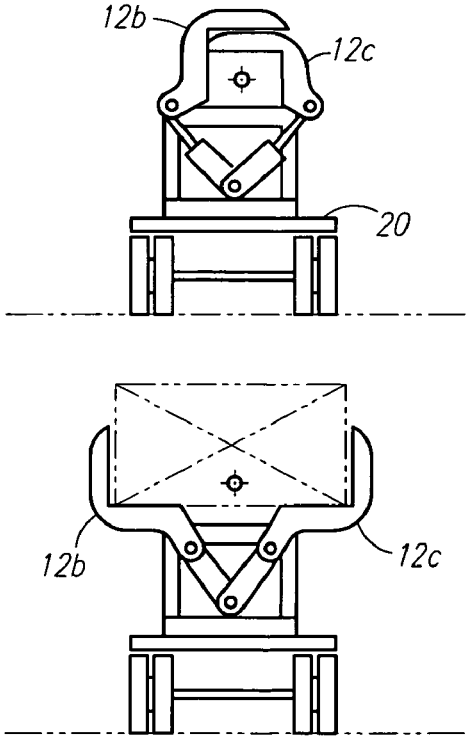
FIG. 4 is a section view of the feeder and elements of FIG. 2.
Figure 5A:
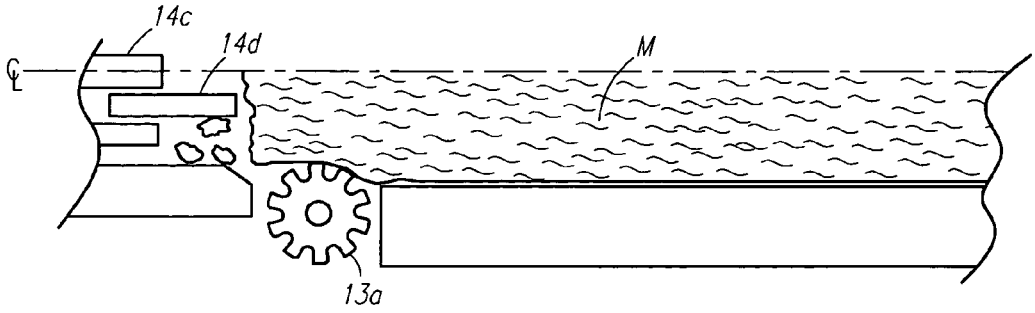
FIG. 5A is top plan view of a toothed feed roll.
Figure 5B:
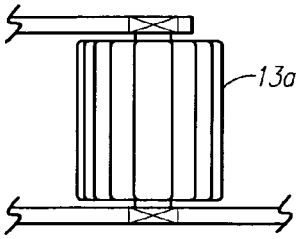
FIG. 5B is a partial side elevational view of the toothed feed roll of FIG. 5A.
Figure 6A:
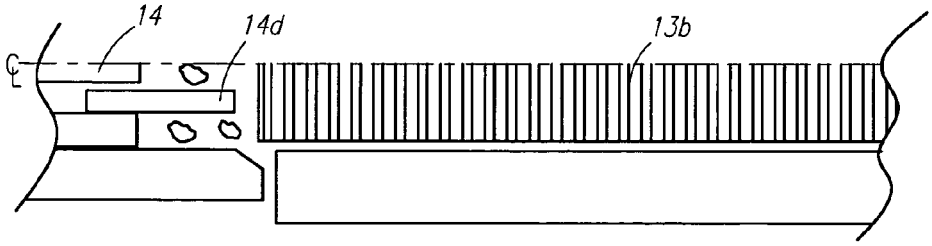
FIG. 6A is a top plan view of a metal track conveyor.
Figure 6B:
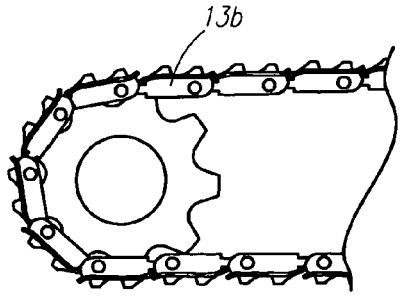
FIG. 6B is a partial side elevational view of the metal track conveyor of FIG. 6A.

Generally, the feeder 12 advances the scrap material M into the shredder 14 for reduction via a mechanism such as a telescoping ram cylinder 12*a* (shown as the preferred embodiment), a toothed feed roll (13*a*), or metal track conveyor (13*b*). The feeder 12 further includes a compressing means for compressing a quantity of scrap material M, the compressing means comprising a plurality of arms, which are further divided into pairs of arms 12*b* and 12*c*, each arm hydraulically actuated to accommodate the particular desired dimension of the material M inserted into the feeder. The arms 12*b* and 12*c* may be opened or closed through actuation, and in the "open" position, the arms 12*b* and 12*c* serve as the collection point for the materials to be compressed and then shredded. As depicted in FIG. 2 and FIG. 4, the arms 12*b* and 12*c* are inwardly biased so as to create a desired shape and dimension of material after compression. Further, the arms 12*b* and 12*c* are actuated, preferably by hydraulic cylinders, but may be actuated by other motive means, so as to provide high compressive force that compacts the collected material into the desired shape and dimension. After compression, the arms 12*b* and 12*c* remain in a "closed" position to generally conform to the shape and dimension of the material M, providing stability and resistance against the material M as it advances to the shredder 14.

Compression of materials M allows achievement of a greater efficiency of scale in that a smaller shredder may be used to achieve a cutting intensity equal to larger machines and lower machinery and operating costs are realized.

Figure 1:
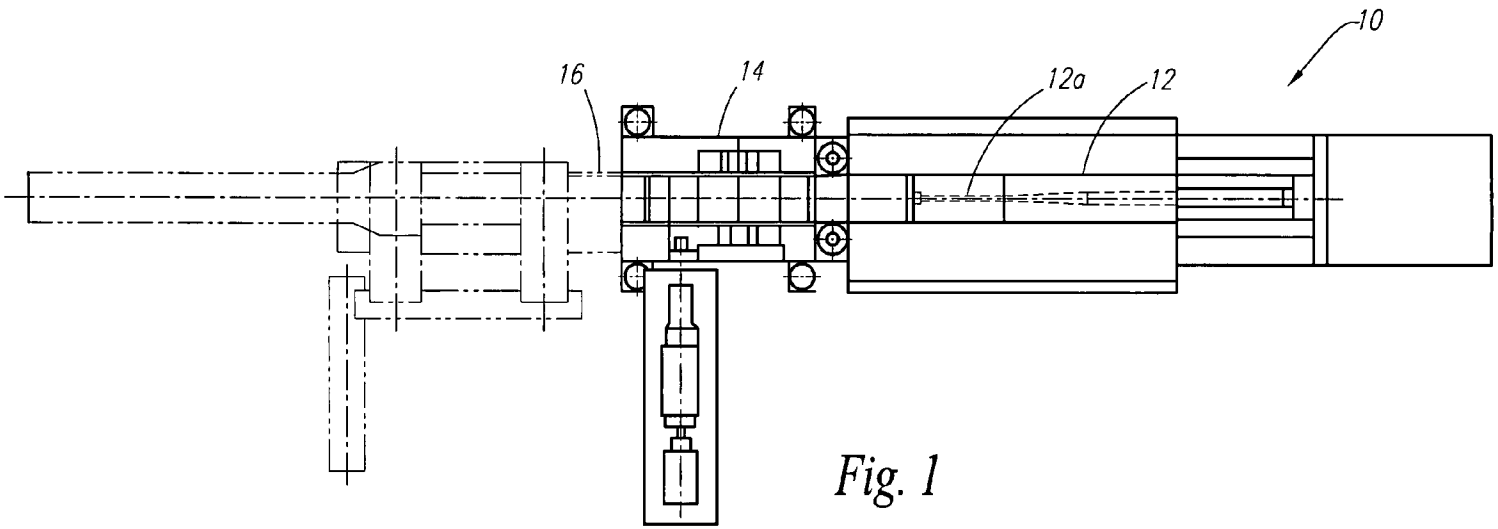
FIG. 1 is a plan view of the apparatus and system for shredding and compressing scrap material.
Figure 3:
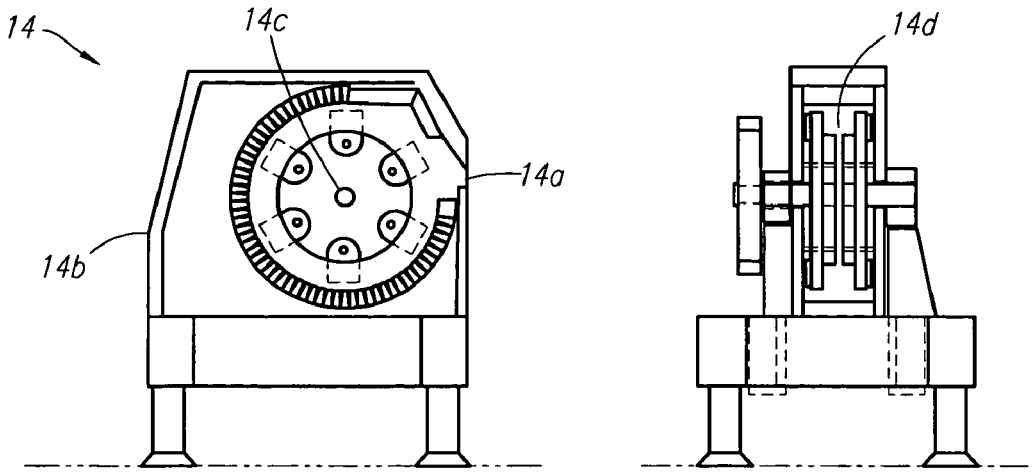
FIG. 3 is a section view of the shredder of FIG. 2.

As depicted in FIG. 1 and FIG. 3, the shredder 14 has an inlet 14*a* and an outlet 14*b*, and a rotor 14*c* with a plurality of hammers 14*d* or teeth intermediately disposed between the inlet 14*a* and outlet 14*b*, wherein hammers 14*d* being free to swing with respect to the rotor 14*c*. The rotor 14*c* is mechanically rotated so that the hammers 14*d* engage the material M and shred or grind the material M into smaller and more manageable portions for discharge to the separator 16. The rotor 14*c* defines a diameter having a greater measure than a width of rotor 14*c*, thereby allowing for a higher cutting force. In addition, the rotor 14*c* having a width with a smaller measure than its diameter reduces cost energy usage, but requires the use of a compression feature.

The separator 16 may comprise a variety of devices and techniques for separating the reduced material M, including but not limited to the use of an electromagnetic means, such as at least one magnet or an eddy current device, a pneumatic means, such as an air classifier, a fluid bed, or a destoner, and/or a mechanical means, such as a splitter chute, a roller screen, a vibratory screen, a ferrous stacking conveyor, or a mixed nonferrous collection means. Particularly with the use of magnet(s) separators or eddy current separators, the fractional compositions produced usually result in a clean ferrous (iron/steel) fraction of approximately 80%, a mixed nonferrous metal fraction of approximately 5%, and a mixed non-metallic fraction comprising the remainder of the quantity fraction. One feature and advantage provided by the apparatus 10 is to generate a more pure reduced material M that permits an end-user consumer (manufacturer) to utilize the reduced material M that has fewer impurities than similar reduced material M generated by existing and less satisfactory reduction methods. The apparatus 10 provides the separation means in a compact transportable fashion matched in capacity to the upstream compression and shredding apparatus. In this manner, the ability to shred and separate, for example an obsolete automobile, is now provided in a compact system with lower operation and maintenance costs than the state of the art, which is limited by aforementioned feeding size requirements to large-scale permanently installed operations.

As previously disclosed, another feature and advantage to the apparatus and system is the adaptability of the apparatus and system for configuration onto a mobile or transportable unit 20. It is envisioned that such a unit or units may comprise any of a variety of multi-axle semi-trailer hauled beds, including a flatbed, an extendable flatbed, a drop deck and double drop deck (extendable), a low boy, a tank trailer, a dolly trailer, a trunnion axle trailer, a platform trailer, and a 9-axle, 13-axle, or a 19-axle trailer, and other similarly suitable hauling trailers capable of supporting such an apparatus or system combination as described above.

A system for shredding and compressing scrap material M is envisioned, the system comprising at least a shredding (hammer-mill) apparatus, a compressing apparatus, and a discharge apparatus consistent with the elements disclosed above with regard to the apparatus, with the system wholly or partially mounted to one of the mobile or transportable units described above. The system may be more particularly described as comprising an engine driven power plant, including a motor or hydraulic drive, a feed system, at least one metal shredder, at least one discharge conveyor, at least one residue conveyor, at least one stacking conveyor, a magnet separator system, dust extraction means, and a plurality of controls for operating the system. The power plant is operatively coupled to the elements of the system requiring direct powered input for operation. The feed system is substantially similar to the feeder described above, with variations envisioned to accommodate size requirements or restraints. Once the material M has been reduced by the metal shredder, a discharge conveyor may transport the material M from the shredder to the separator, wherein, for example, a magnet and/or air separator separates the material into various fractions. The residue conveyor will transport the fractions to various stations as provided in the particular configuration (set up to accommodate the specific material(s) reduced).

Further separation means may be used on the residue stream, including but not limited to eddy-current separation, air separation, or other means as may be warranted by the materials being processed. One or more stacking conveyors are engaged thereafter to stack the material M as desired. Alternatively, separators may discharge directly into receiving means, such as hoppers, bins, and the like. A dust extraction means is incorporated into the system to eliminate any excessive dust generated in the reduction of the material M, and may be incorporated at one of several points in the process utilized within the system, and may further include multiple dust extraction means if the reduction is particularly prone to multiple areas of excessive dust generation. A plurality of controls may be provided to extend control over various elements of the system and over various phases of the process used within the system.

By way of example only, there are at least two envisioned embodiments encompassing the mobility or transportability of the system described above, with special interest in the area of pulverizing automobile material, such as in a junkyard. For the sake of labeling only, the at least two embodiments are labeled as a "mobile system" and a "portable system", though other suitable labels may be used and substituted without limitation to the scope of the invention or the claims.

In a "mobile system", it is envisioned that the mobile system would be capable of shredding/grinding/pulverizing approximately 6-10 automobiles per hours, or approximately 80-100 tons of material per day. In one embodiment of the mobile system, a reliable diesel engine power unit is provided to power aspects of the system. The mobile system is intended to provide mobility via the various trailers described above, with a relatively simple set-up for use, and configured to avoid the need for special transportation permits on the highways or other roads.

Alternately, in a "portable system", it is envisioned that the portable system would be capable of shredding/grinding/pulverizing approximately 20 automobiles per hour, or approximately 200 tons of material per day. The system may be operated with an engine or electric motor driven power unit. A skid mounted platform may be utilized, while providing the transportability desired, although special transportation permits may be required for moving from one location to another, due to the system's weight and size.

It is to be understood that the embodiments and claims are not limited in its application to the details of construction and arrangement of the components set forth in the description and illustrated in the drawings. Rather, the description and the drawings provide examples of the embodiments envisioned, but the claims are not limited to the specific embodiments. The embodiments and claims disclosed herein are further capable of other embodiments and of being practiced and carried out in various ways, including various combinations and subcombinations that may not have been explicitly disclosed. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the U.S. Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. It is intended that the application is defined by the claimed appended hereto.

What is claimed is:

1. A scrap material recycling apparatus comprising:

a feeder;

a separator;

and a shredder;

the feeder and the shredder mutually coupled;

the shredder and the separator mutually coupled;

the feeder comprising a compressing means for compressing a quantity of scrap material to a size adapted for being received by an inlet of the shredder, the compressing means comprising a plurality of arms divided into pairs of arms, wherein each of the pairs of arms is hydraulically actuated to accommodate a particular desired shape and dimension of the scrap material inserted into the feeder, the pairs of arms are opened and closed through actuation, the pairs of arms are each inwardly biased so as to create a desired shape and dimension of the scrap material after compression thereof, the pairs of arms are actuated to provide a high compressive force that compacts the scrap material into the desired shape and dimension, and after compression of the scrap material, the pairs of arms remain in a closed position to generally conform to the shape and dimension of the scrap material, thereby providing stability and resistance against the scrap material as it advances to the shredder;

the feeder comprising means for advancing the scrap material to the shredder; and the shredder comprising a rotor having a plurality of cutting means, the rotor mechanically rotated to reduce the scrap material, and wherein the rotor defines a diameter having a greater measure than a width of the rotor, thereby allowing for a higher cutting force and reducing cost energy usage by the scrap material recycling apparatus during operation thereof.

2. The apparatus of claim 1, wherein advancing means comprises a telescoping ram cylinder.

3. The apparatus of claim 1, wherein advancing means comprises a toothed feed roll.

4. The apparatus of claim 1, wherein advancing means comprises a conveyor.

5. The apparatus of claim 1, wherein said shredder comprising an inlet and an outlet mutually opposed, the inlet receiving scrap material from the feeder.

* * * * *